US009062469B2

(12) United States Patent
Auston

(10) Patent No.: US 9,062,469 B2
(45) Date of Patent: Jun. 23, 2015

(54) SAFETY ANCHOR DEVICE

(75) Inventor: Oliver Auston, Ashford (GB)

(73) Assignee: CHECKMATE LIMITED, Sheerness, Kent (GB)

( * ) Notice: Subject to any disclaimer, the term of this patent is extended or adjusted under 35 U.S.C. 154(b) by 49 days.

(21) Appl. No.: 13/146,972

(22) PCT Filed: Jan. 27, 2010

(86) PCT No.: PCT/GB2010/050118
§ 371 (c)(1),
(2), (4) Date: Sep. 8, 2011

(87) PCT Pub. No.: WO2010/086648
PCT Pub. Date: Aug. 5, 2010

(65) Prior Publication Data

US 2011/0309226 A1 Dec. 22, 2011

(30) Foreign Application Priority Data

Jan. 30, 2009 (GB) ..... 0901634.6

(51) Int. Cl.

| | |
|---|---|
| ***A47B 91/00*** | (2006.01) |
| ***E04G 21/32*** | (2006.01) |
| *A62B 35/00* | (2006.01) |
| *A62B 35/04* | (2006.01) |

(52) U.S. Cl.
CPC ..... *E04G 21/3261* (2013.01); *A62B 35/0068* (2013.01); *A62B 35/04* (2013.01)

(58) Field of Classification Search
CPC . E04G 21/3261; A62B 35/0068; A62B 35/04
USPC ..... 248/148, 237, 346.2, 504, 506, 910; 119/770, 792; 280/187
See application file for complete search history.

(56) References Cited

U.S. PATENT DOCUMENTS

| | | | | |
|---|---|---|---|---|
| 2,232,163 | A * | 2/1941 | Brecht | 119/770 |
| 2,260,437 | A * | 10/1941 | Chambers | 5/653 |
| 4,280,235 | A | 7/1981 | Kowal | |
| 5,897,018 | A * | 4/1999 | Pruitt | 220/603 |
| 7,480,952 | B2 * | 1/2009 | Nickerson et al. | 5/655.3 |
| 2013/0043365 | A1 * | 2/2013 | Harel | 248/346.2 |

FOREIGN PATENT DOCUMENTS

| | | |
|---|---|---|
| AU | 2000-71928 | 5/2001 |
| DE | 31 46 771 | 7/1982 |
| EP | 0 037 085 | 10/1981 |
| JP | 5-337211 | 12/1993 |

* cited by examiner

*Primary Examiner* — Gwendolyn Baxter
(74) *Attorney, Agent, or Firm* — Burr & Brown, PLLC

(57) ABSTRACT

A safety anchor device for limiting movement of a person or arresting a fall of a person working at height, and in particular to an inflatable safety anchor device that may be positioned at a high point and then inflated with a liquid to provide a dead-weight anchor device. A dead-weight anchor device for securing a line to a person working at height comprises an attachment for a line that is provided on a top surface of a flexible-walled container. The container has an internal volume that may in use be inflated with a quantity of water to provide an anchoring dead-weight and subsequently deflated by letting water escape. The container has a plurality of flexible walls, including a pair of walls that are internally connected by drop threads that limit the separation between said pair of walls when the internal volume is inflated by water.

21 Claims, 1 Drawing Sheet

SAFETY ANCHOR DEVICE

BACKGROUND a. Field of the Invention

The present invention relates to a safety anchor device for limiting the movement of a person or arresting a fall of a person working at height, and in particular to an inflatable safety anchor that may be positioned on a roof or other high point and then inflated with a liquid such as tap water to provide a dead-weight anchor device.

b. Related Art

Dead-weight anchor systems, also known as anchor-weight systems, are used when people need to work at height, usually on a roof or a similar structure, and a preinstalled fixed anchor system is not available. A fixed anchor system might not be available because an anchor system has never before been needed at a work location or because there is some difficulty in installing a fixed anchor system or because access is only needed temporarily. A dead-weight anchor system therefore uses an anchor device that can be moved into position and then weighted down to provide a dead-weight anchor.

Dead-weight anchor systems are ideal for flat roofs where no roof penetration is possible, but may be used on any flat or gently sloping surface where the slope is insufficient to destabilise the dead-weight anchor. Examples of other locations include lift-shaft housings on tower blocks, exposed balconies, large beams or sound areas of concrete and geological features.

One type of dead-weight anchor system uses a metal frame with a central eye bolt anchorage point with a centre swivel in an upper surface of the frame. After positioning, the frame may be loaded with weights until the dead-weight anchor has sufficient mass to resist movement when limiting the movement of a person or when arresting a fall of a person working at height connected to the anchor by a safety rope or line. The relevant standard governing dead-weight anchor systems is BS EN 795:1997 and the Code of Practice for their use is BS 7883.

The strength of the attachments to the dead-weight anchor device should at least equal the strength of the rope(s) attached to the safety anchor.

Dead-weight anchor devices themselves should be unquestionably reliable. Wet conditions can significantly affect the frictional performance of dead-weight anchor systems. The frictional resistance of any dead-weight anchor device should be assured by being capable of not moving when subjected to a load of four times that which will be applied when limiting the movement of a person in a work positioning situation. A higher factor will be required if the dead-weight anchor system may be needed to arrest a fall of a person working at height. It may also be necessary to consider the possibility of rescue, which may involve the weight of two persons.

One type of dead-weight anchor device uses an inflatable flexible anchor bag that is positioned for use when empty, and then filled with a liquid, which will normally be tap water, for example by means of a hose. When inflated with water the flexible anchor bag serves as a dead-weight anchor device. The bag may have an inlet to which the hose is temporarily connected when being filled with water. The inlet may also serve as an outlet to drain water when the device is not in use. It is important to have sufficient contact area and mass to provide sufficient friction between a lower side of the device and the supporting surface. To ensure that the lower side remains flat and to provide maximum weight, the flexible anchor bag has an approximately cubic form when inflated with water.

The flexible bag necessarily has flexible walls so that the bag can be collapsed when not in use and expanded when filled with water. This causes a problem when the attachment point is provided on the top surface, as a pull on the bag can cause the anchor bag to roll as the flexible walls deform from the pulling force. To reduce this problem, the safety line or working line attachment are therefore preferably provided on a side of the bag, however, this results in a restriction in the working area that may be covered by a worker working at height, as the safety line or working line should always lead directly to the attachment point and should not be wrapped around the dead-weight anchor device.

It is an object of the present invention to provide a more convenient dead-weight anchor bag for use on a roof or other exposed location at height.

SUMMARY OF THE INVENTION

According to the invention, there is provided a dead-weight anchor device for securing a line to a person working at height, comprising a flexible-walled container with an internal volume that may in use be inflated with a quantity of water to provide an anchoring dead-weight and subsequently deflated by letting said quantity of water escape from the container when not in use, the container having at least one attachment for said line, wherein the container has a plurality of flexible walls, including a pair of walls including bottom wall that in use forms a base adapted to engage with a surface for supporting the weight of the device when inflated with the water and an opposite top wall, characterized in that said pair of walls are internally connected by drop threads that limit the separation between said pair of walls when the internal volume is inflated by said quantity of water and said at least one attachment includes an attachment for said line on said top wall.

The attachment may include an eye bolt or other fixing means for attachment to a worker safety line or working line.

In use, the drop threads provide a degree of internal rigidity to the inflated internal volume, so that the shape of the water inflated container resists deformation when pulled at the attachment, for example when arresting the fall of a worker connected to the attachment by a safety line. Because the inflated container substantially maintains its shape under such stresses, the dead-weight anchor device resists rolling and maintains frictional contact with a supporting surface.

In a preferred embodiment of the invention, the drop threads extend across the internal volume, most preferably between the top and bottom sides or surfaces of the container.

The drop threads extend between the pair of opposite top and bottom walls with adjacent drop threads extending in a parallel direction when the internal volume is inflated with water.

To provide maximum rigidity the drop threads are preferably provided over substantially the whole extent of the opposite portions of the pair of walls. In a preferred embodiment the drop threads are provided at a typical density of six threads per square centimetre.

Because the dead-weight anchor device resists deformation of shape and rolling, the attachment may advantageously be provided on an upper surface of the container, for example in a central portion of the top wall. This then permits the worker to move in an arc around all sides of the dead-weight anchor device without the connecting line becoming wrapped around any portion of the device. A useful way of using the weight anchor is by stringing a line between two or more anchors to which the worker is attached with a sliding harness attachment line.

In a preferred embodiment of the invention, the top and bottom walls are connected at their peripheries by one or more side walls that extend around the periphery of the device.

The dead-weight anchor device may also comprise an inlet for admitting water to the internal volume of the container, this inlet being provided on a side wall that extends between the top and bottom walls. The inlet may be provided in an upper portion of said side wall and may comprise a spout that extends laterally away from the side wall, preferably extending in a direction directly away from the attachment on the flexible container for the safety line or work line. This helps to prevent the spout from being snagged by the connecting line as the worker moves about.

BRIEF DESCRIPTION OF THE DRAWINGS

The invention will now be further described, by way of example only, and with reference to the accompanying drawings, in which.

DETAILED DESCRIPTION

Figure 1:
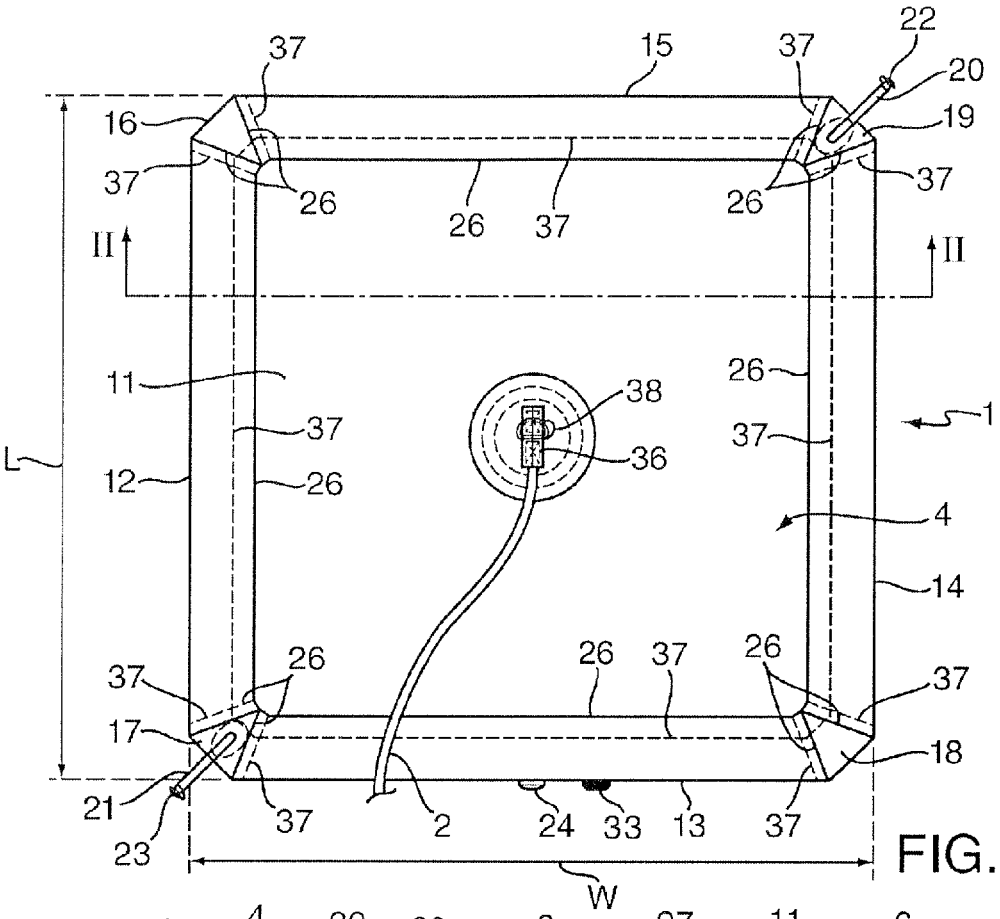
FIG. 1 shows a plan view from above of a dead-weight anchor device according to a preferred embodiment of the invention.
Figure 2:
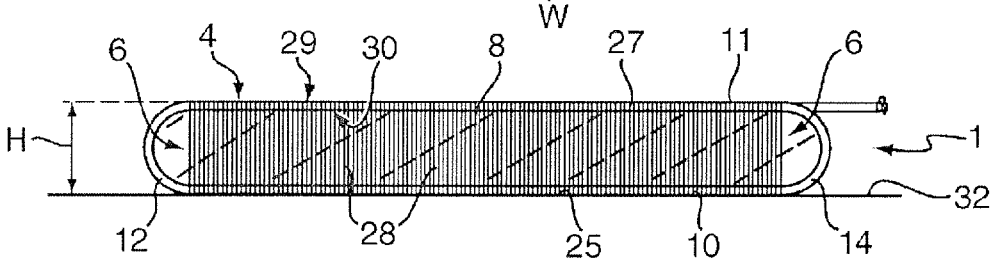
FIG. 2 is a cross-section through the dead-weight anchor device, taken along line II-II of FIG. 1.

FIGS. 1 and 2 show a dead-weight anchor device 1 for securing a safety or work line 2 to a person working at height (not shown). The device 1 has a substantially square outline as seen from above in the plan view of FIG. 1, formed by a flexible-walled container 4 with an internal volume 6 that in use is filled with a quantity of water, indicated by diagonal dashes 8 in FIG. 2.

The container has six main flexible walls 10-15 including a substantially flat bottom wall 10, a substantially flat top wall 11 that is generally parallel with and opposite to the bottom wall, and four convexly curved side walls 12-15 that extend between the bottom and top walls 10, 11. The container also has four convexly curved corner side walls 16-19 that extend between the bottom and top walls 10, 11 and which are angled at 45° to the adjacent main side walls. As seen in FIG. 2, each main side wall 12-15 has a semicircular profile. Together the walls 11-19 fully enclose the internal volume 6 of the container 4.

The internal volume 6 is filled with water 8 by means of one or more inlet spouts 20, 21, provided on the side wall sections 17, 19 so that at least one spout will be conveniently located with respect to a water source. Each spout has an end cap or valve 22, 23 that can be opened and closed as required. In use a hose (not shown) is temporarily connected to one of the spouts 20, 21 when opened, and after the volume 6 has been substantially or completely filled, the hose is disconnected and end cap 22, 23 closed to seal in the water 8.

When the dead-weight anchor device 1 is no longer needed at a particular location, a drain cap 24 is opened so that water is let out of the volume 6.

The container 4 may optionally have a pressure relief valve 33 to prevent this from bursting by excessive water pressure.

The walls 10-19 are flexible, being preferably made from polymer coated fabric in sections that are bonded together along seams 26 that run between adjacent sections 10-19. The bond between wall sections is made in overlap regions along the seams shown by dashed lines 37.

Because the walls 10-19 are flexible, the container may be collapsed and folded or rolled (not shown) up when not in use. When the internal volume of the container is filled with water 8 the container walls become inflated and assume the shape shown in the drawings.

As shown in FIG. 2, the internal volume 6 is crossed by multiple drop threads 28 that extend transversely between the bottom and top walls 10, 11. The ends 25, 27 of each drop thread are woven within the thickness of the material forming the bottom and top walls, between outer and inner surfaces 29, 30 of the container 4.

The drop threads limit the expansion and ultimate separation between the bottom and top walls 10, 11 and so constrain the shape of the inflated container 4, and hence also the amount of water 8 that may be put into the container. The ultimate quantity of water inside the container has sufficient mass to provide a dead-weight so that the line 2 is securely anchored. One advantage of the drop threads 28 is therefore to limit the amount of water 8 that may be put inside the container 4, which avoids the problem of potentially overloading a supporting surface 32 on which the dead-weight anchor device 1 rests. The drop thread arrangement therefore predetermines the amount of liquid that may be put into the container 4 and therefore predetermines the anchoring mass of the device 1.

The main benefit of the drop threads however, is to provide a degree of internal rigidity to the container 4. This is particularly beneficial as the container 4 has a squat profile, being about 200 mm high (H), and 1.5 m wide (W) and 1.5 m long (L). The low centre of mass relative to the container 6 provided by this arrangement is helpful in permitting the dead-weight anchor device to be used on gently sloping surfaces.

The container 4 has in the centre of the top side 11 an attachment 36 with swivel 38 for connection to the safety or work line 2. The attachment 36 may be an eye for an eye bolt or karabiner (not shown) or any other suitable attachment means. The forces from any lateral pull on the centrally located attachment 36 will be transmitted by the material of the top wall 11 and to the drop threads 28 and to the bottom wall 10. Although the top wall may shift slightly in the direction of the pull, the drop threads 28 will restrain the movement and so the effect of the drop threads 28 is to substantially maintain the external shape of the filled container when pulled at the attachment 36. Sudden tension at the attachment 36 causes a distortion of the bag and motion of the water inside which has a significant effect in absorbing the energy of a fall. This advantage is not experienced by rigid weight anchors which therefore need to have greater mass for the same level of security.

Figure 3:
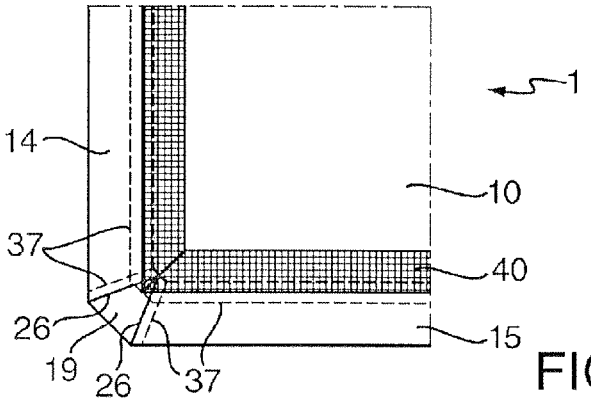
FIG. 3 is a view of a portion of the underside of the dead-weight anchor device of FIG. 1, showing a high friction strip that extends around the periphery of the base of the device.

As shown in FIG. 3, the bottom wall may have around an outer periphery or over the whole surface a friction material 40, which may be a compliant and/or textured strip of rubber or other high friction material. In use, this will tend to engage the supporting surface 32, thereby helping to anchor the device 1 to remain in place.

The device has a substantially square outline as seen from above in the plan view of FIG. 1. The invention is, however, applicable to other outline profiles, for example round or rectangular. A round shape will provide the same anchoring effect from any direction with respect to a pull on a central attachment. A rectangular shape will provide a preferential restraint along the long axis of the rectangle, and may be appropriate where there are constraints on the positioning of the device or where the working angle of the line 2 is always close to the long axis of the rectangle.

In the present example, the height or thickness (H) between the bottom and top sides 10, 11 is about 200 mm. The diagonal extent of the inflated anchor bag is about 2100 mm. The ratio of the thickness between the top and bottom sides to the diagonal extend of the dead-weight anchor device is therefore about 0.095.

The invention is applicable to other shapes that are more or less squat, but preferably the ratio of the maximum separation between the top and bottom walls to the maximum extent in any direction of the base should be less than 0.5. Above this ratio, rigidity is progressively lost as the drop threads become longer relative to the size of the base. However, the preferred ratio of the maximum separation between the top and bottom walls to the maximum extent in any direction of the base is between about 0.05 and about 0.15.

In the present example, the container is formed by first making a curved edge piece from eight pieces 12-19 of a polymer coated fabric. The fabric is waterproof and bondable to the drop thread material and to itself by adhesive, vulcanised or welded joints.

This curved edge piece is then bonded to a square piece of the drop thread material, sometimes referred to as pile fabric, consisting of the bottom and top walls 10, 11 and the joining drop threads 28. The base fabric for the drop thread material is high tenacity polyester 1100 Dtex with an external coating of polychloroprene (Neoprene) and the drop threads are made from double ply Nylon 470 Dtex. The weight of the drop thread material is 2400 g/m$^2$ (±10%). The tensile strength of the drop thread material is about 350 daN/5 cm (weft) and about 400 daN/5 cm (warp).

In the event of a fall the dead-weight anchor device according to the invention will resist deformation or rolling and will act as an effective fall arrest device.

The use of a drop thread material extending across the short dimension of the dead-weight anchor bag makes the bag a more suitable shape as compared with a simple water-filled bag. The result is that the dead-weight anchor device according to the invention can be used on a roof having a greater slope than would be possible with a simple water-filled bag.

The invention therefore provides a dead-weight anchor device that has roll resistance to lateral forces imparted on a working line or on a safety line when braking the fall of a worker attached to the a safety line.

It should be understood that the invention has been described above by way of example only and that modifications in detail may be made without departing from the scope of the invention as set out in the claims. For example, the side walls could be a single narrow strip of material, however this does not make best use of the drop thread material, which is relatively more expensive than the side wall material.

The invention claimed is:

1. A dead-weight anchor device for securing a line to a person working at height, comprising a flexible-walled container having a plurality of flexible walls defining an internal volume that may in use be inflated with a quantity of water to provide an anchoring dead-weight and subsequently deflated by letting said quantity of water escape from the container when not in use, the flexible walls including a bottom wall that in use forms a base adapted to engage with a surface for supporting the weight of the device when inflated with water and an opposite top wall, said top and bottom walls being internally connected by drop threads that limit the separation between said top and bottom walls when the internal volume is inflated by said quantity of water, each of the drop threads having a first end attached to an internal surface of the top wall and a second end attached to an internal surface of the bottom wall, the respective first ends distributed over substantially an entirety of the internal surface of the top wall, the respective second ends distributed over substantially an entirety of the internal surface of the bottom wall, and the container having at least one attachment on the top wall for said line.

2. A device as claimed in claim 1, in which the drop threads extend across said internal volume.

3. A device as claimed in claim 1, in which said attachment for said line on said top wall is provided at a central portion of said top wall.

4. A device as claimed in claim 1, in which the top and bottom walls are connected at their peripheries by one or more side walls.

5. A device as claimed in claim 1, comprising an inlet for admitting water to the internal volume of the container, said inlet being provided on a side wall that extends between the top and bottom walls.

6. A device as claimed in claim 5, in which the inlet is provided in an upper portion of said side wall.

7. A device as claimed in claim 6, in which the inlet comprises a spout that extends laterally away from said side wall.

8. A device as claimed in claim 1, in which the periphery of the base includes a friction strip to enhance friction between the base and a supporting surface.

9. A device as claimed in claim 8, in which the friction strip comprises compliant rubber.

10. A device as claimed in claim 8, in which the friction strip comprises textured rubber.

11. A device as claimed in claim 1, in which the device in use when viewed from above has a substantially square or rectangular outline.

12. A device as claimed in claim 1, in which the ratio of the maximum separation between the top and bottom walls to the maximum extent in any direction of the base is less than 0.5.

13. A device as claimed in claim 1, in which the ratio of the maximum separation between the top and bottom walls to the maximum extent in any direction of the base is between 0.05 and 0.15.

14. A device as claimed in claim 1, in which said flexible walls define a single internal volume of the container.

15. A device as claimed in claim 1, in which the container comprises an inlet for admitting water to the internal volume of the container, and a separate drain cap for draining water out of the internal volume.

16. A device as claimed in claim 15, in which the container further comprises a pressure relief valve.

17. A device as claimed in Claim 15, in which the drop threads are provided over substantially the whole extend of the top and bottom walls.

18. A device as claimed in claim 1, in which the drop threads are distributed at substantially even density over the whole extent of the internal surface of the bottom wall and the whole extent of the internal surface of the top wall.

19. A device as claimed in claim 1, in which the drop threads are distributed at a density of six threads per square centimeter over the internal surface of the bottom wall and the internal surface of the top wall.

20. A device as claimed in claim 1, in which adjacent drop threads extend in a parallel direction when the internal volume is inflated with water.

21. A device as claimed in claim 1 , in which the ends of each drop thread are woven within the thickness of the material forming the bottom and top walls.

* * * * *

UNITED STATES PATENT AND TRADEMARK OFFICE

CERTIFICATE OF CORRECTION

PATENT NO. : 9,062,469 B2
APPLICATION NO. : 13/146972
DATED : June 23, 2015
INVENTOR(S) : Oliver Auston It is certified that error appears in the above-identified patent and that said Letters Patent is hereby corrected as shown below:

In the specification,

Col. 2, Line 30

Please change: "of flexible walls, including a pair of walls including bottom" to -- of flexible walls, including a pair of walls including a bottom --

Col. 2, Line 32

Please change: "for supporting the weight of the device when inflated with the" to -- for supporting the weight of the device when inflated with --

In the claims,

Claim 17, Line 50

Please change: "threads are provided over substantially the whole extend of" to -- threads are provided over substantially the whole extent of --

Signed and Sealed this
Fifteenth Day of March, 2016

Michelle K. Lee

Michelle K. Lee
*Director of the United States Patent and Trademark Office*